United States Patent [19]

Foresi et al.

[11] Patent Number: 4,509,740

[45] Date of Patent: Apr. 9, 1985

[54] SHEET STACKING SYSTEM

[75] Inventors: Anthony Foresi; Peter Naysmith, both of Allen Park, Mich.

[73] Assignee: Anthony Foresi & Associates, Inc., Allen Park, Mich.

[21] Appl. No.: 457,094

[22] Filed: Jan. 10, 1983

[51] Int. Cl.[3] ..... B65H 31/20

[52] U.S. Cl. ..... 271/224

[58] Field of Search ..... 271/220, 221, 222, 223, 271/224

[56] References Cited

U.S. PATENT DOCUMENTS

| | | | |
|---|---|---|---|
| 2,733,064 | 1/1956 | Martin | 271/224 |
| 3,049,349 | 8/1962 | Siglow | 271/224 |
| 3,395,914 | 8/1968 | Buccicone | 271/224 |

FOREIGN PATENT DOCUMENTS

| | | | |
|---|---|---|---|
| 875206 | 8/1961 | United Kingdom | 271/224 |

*Primary Examiner*—Richard A. Schacher

*Attorney, Agent, or Firm*—Krass & Young

[57] ABSTRACT

A system for stacking metal sheets onto a pallet positioned on a conveyor oriented in a complex angle. Positioning of side gates and stops defining the stacking area is accomplished automatically so that the system may be easily adapted to sheets of different sizes.

7 Claims, 5 Drawing Figures

SHEET STACKING SYSTEM

DESCRIPTION

Technical Field

This invention relates to material handling devices and, more particularly, to systems for stacking sheets of materials.

Background Art

Rectangular sheets of metal are generally formed by a press or the like which cuts the metal into the desired shape. It is necessary to stack these sheets into a pile with very square edges for several reasons. Normally, the sheets are stacked onto a pallet which may be moved to various locations with a forklift truck or similar equipment. If one or more of the sheet edges sticks out from the stack they may be deformed and bent if bumped by the forklift or other machinery in the plant. It is also important that the stack be very square so that automatic de-stacking devices can be used. These de-stacking devices depend upon the exact position of the sheets in the stack. If one of the sheets is out of alignment it may be fed into a subsequent machining operation in an improper orientation. Improper alignment of the stack may also result in problems when suction cups are used to lift the sheets off of the stack.

One successful form of sheet stacking system utilizes a conveyor that is oriented in a complex angle. The pallet is positioned on the conveyor in a stacking area defined by a pair of side gates running across the conveyor and end stop devices on either side of the conveyor. One of the end stop devices includes a pair of swinging paddles which operate to tap the sheet fed from the cutting machine into exact alignment with the stack of sheets being formed on the pallet.

The known stacking system of this type has its drawbacks in that it is very time consuming to make the necessary adjustments to accommodate different sheet sizes. The gates and stops must be manually moved into position to accurately define the required stacking area for a given size sheet. It is important that each of the side gates be precisely spaced an equal distance from the stacking area central axis for the stacks to be aligned properly. The accurate positioning of these gates is difficult to obtain in the known systems since the gates move independently of each other.

Summary of the Invention

The present invention provides an improved sheet stacking system that may be automatically adjusted to accommodate different sheet sizes. Means are provided for automatically moving the side gates in unison relative to the central stacking area axis on the conveyor. In the preferred embodiment, a screw drive having a right hand thread driving one of the gates and a left hand thread driving the other gate is advantageously utilized. Means are also provided for automatically moving the pivoting paddle stops into the desired position relative to the ends of the sheets to be stacked. The preferred embodiment employs a framework utilizing a pair of scaffolds for positioning and raising the side gates. A telescoping cross bar arrangement between the scaffolds supports a raised screw drive mechanism for moving the paddle stops into their desired position.

BRIEF DESCRIPTION OF THE DRAWINGS

The various advantages of the present invention will become apparent to one skilled in the art upon reading the following specification and by reference to the drawings in which.

DESCRIPTION OF THE PREFERRED EMBODIMENT

Figure 1:
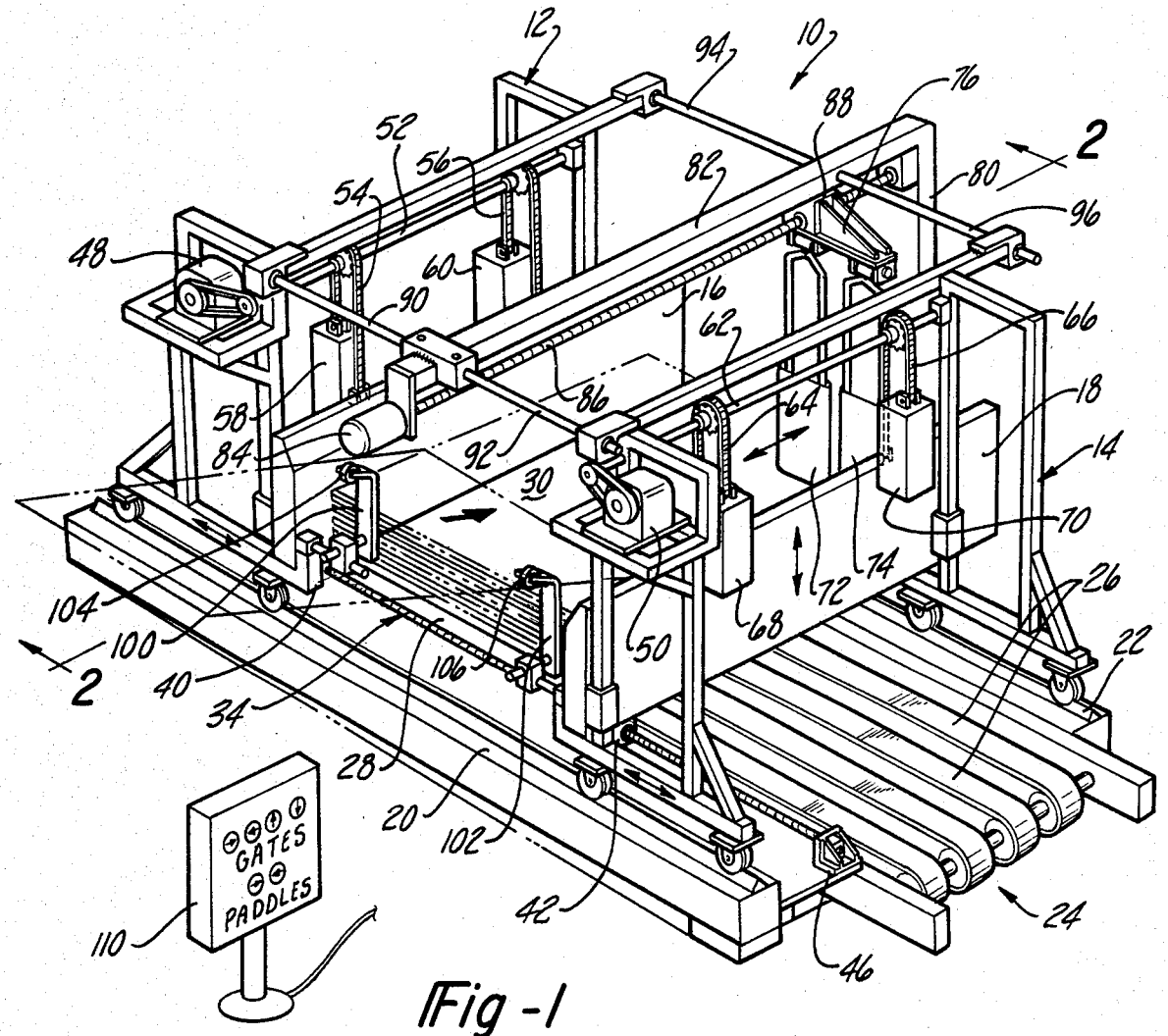
FIG. 1 is a perspective view of the preferred embodiment of the sheet stacking system of the present invention.
Figure 2:
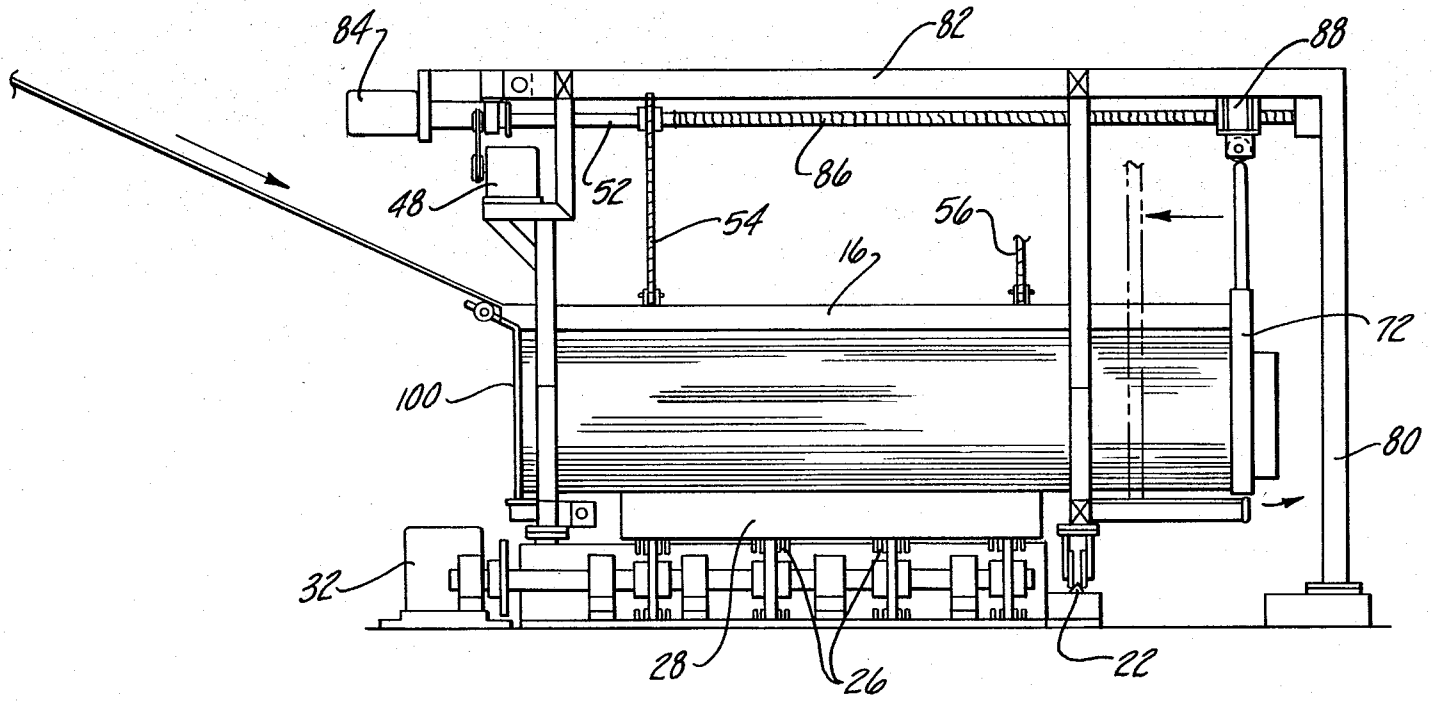
FIG. 2 is a side elevation of the system viewed along the line 2 in FIG. 1.

Referring now to the drawings, especially FIG. 1, the preferred embodiment of the sheet stacking system 10 employs a pair of scaffolds 12 and 14 carrying side gates 16 and 18, respectively. Scaffolds 12 and 14 ride on tracks 20 and 22 which are disposed on opposite sides of conveyor 24. Conveyor 24, in this embodiment, utilizes a plurality of chain driven belts 26 operating to move a pallet 28 into and out of a stacking area generally designed by the numeral 30. The conveyor 24 is driven by a motor 32 and a suitable gearing arrangement as can be seen most clearly in FIG. 2.

Figure 3:
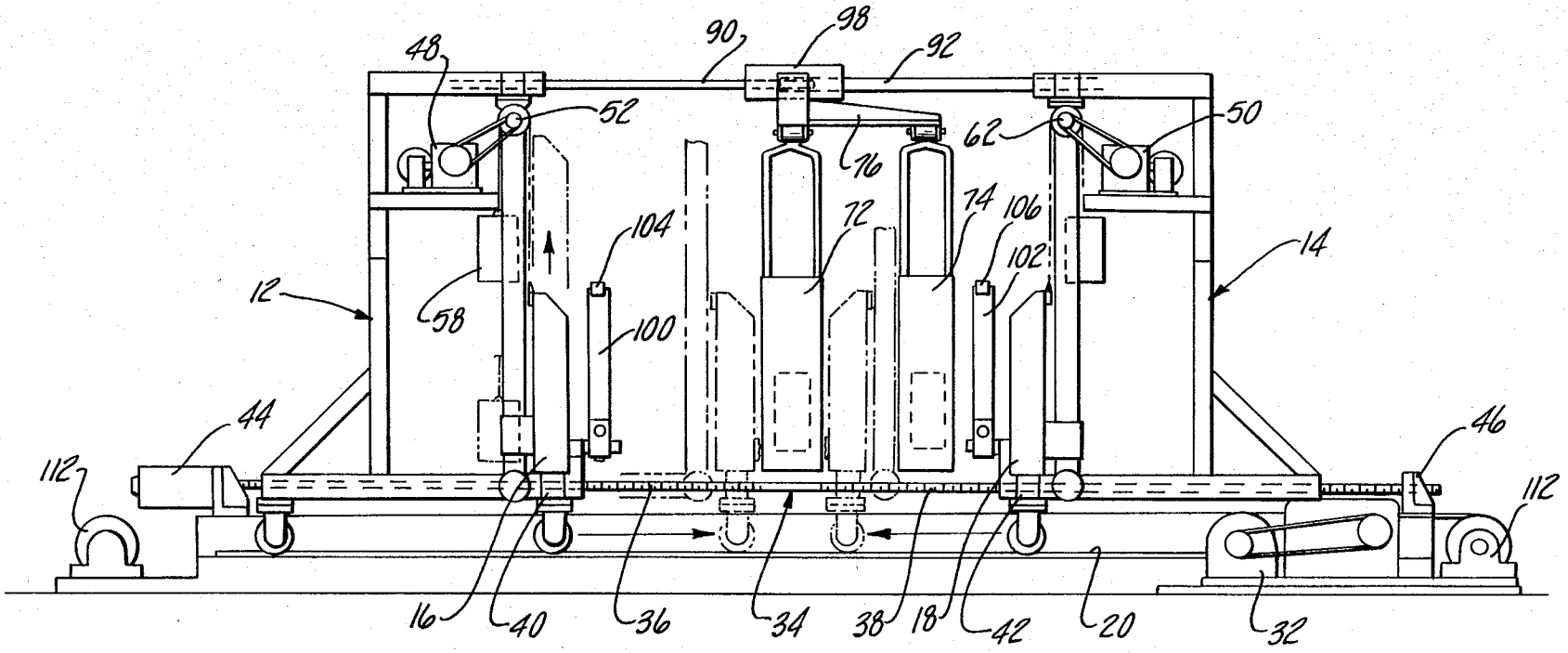
FIG. 3 is a front elevation view illustrating in phantom lines the movement of the side gates.

Gates 16 and 18 are moved in unison normal to the central stacking area axis which extends transversely across conveyor 24. This is accomplished by way of a screw drive mechanism employing a screw 34 coupled to scaffolds 12 and 14 as can be seen most clearly in FIG. 3. Approximately one half of screw 34 is formed with a right hand thread 36 while the other half of screw 34 is formed with a left hand thread 38. Screw thread 36 engages a suitable nut coupling 40 in scaffold 12. Similarly, screw thread 38 engages nut coupling 42 in scaffold 14. Rotation of screw 34 is performed automatically by motor 44 coupled to one end of the screw whose opposite end is supported by bushing 46. Motor 44 is preferably a reversible electric motor. Due to the design of screw 34, the scaffolds 12 and 14 will move outwardly from one another when motor 44 is rotating in one direction and then will move toward each other when motor 44 is reversed. Thus, the gates 16 and 18 are always spaced equidistant from the stacking area axis.

Scaffolds 12 and 14 include raised platforms onto which motors 48 and 50 are mounted, respectively. Motors 48 and 50 serve to automatically lift and lower gates 16 and 18, respectively, to allow clearance for the pallet to be moved into and out of stacking area 30. Motor 48 drives a sprocketed shaft 52 coupled to chains 54 and 56. The ends of the chains 54 and 56 are connected to upper portions of gate 16 and their opposite ends are connected to counterweights 58 and 60. Similarly, motor 50 drives shaft 62 whose rotation controls the vertical movement of gate 18 via chains 64, 66 and associated counter weights 68 and 70.

A pair of pivoting paddles 72 and 74 serve as stop devices for the forward edge of the sheets to be stacked. The upper ends of paddles 72 and 74 are pivotally connected to an arm 76. The arm 76 is movable along the central stacking area axis by way of a screw drive mechanism supported by a framework superstructure. A post 80 includes a beam 82 extending above stacking area 30. The cantilevered end of beam 82 has a motor 84 connected thereto for driving screw 86. Screw 86 engages a nut coupling 88 in arm 76. Thus, operation of motor 84 serves to move arm 76 which acts as a traveller to move paddles 72, 74 towards and away from stacking area 30.

Two pairs of telescoping tubes 90, 92 and 94, 96 provide support for paddle screw drive mechanism. As can be seen most clearly in FIG. 3, tubes 90, 92 meet at a junction box 98. The telescoping arrangement of the two tube pairs serves to accomodate various positions of the side gate scaffolds 12 and 14 and thus provide support regardless of the position of the gates.

A pair of rigid front stops 100, 102 complete the definition of stacking area 30. Stops 100, 102 extend vertically and then are bent outwardly in the direction of the flow of sheets to be stacked. If desired, the upper portions of stops 100, 102 include rollers 104, 106, respectively, to facilitate movement of the sheets into the stacking area.

Rounding out sheet stacking system 10, a controller 110 is provided which controls the operation of screw drive motor 44, gate lift motors 48, 50, and paddle motor 84. As shown in FIG. 1, controller 110 includes suitable buttons thereon for automatically positioning the gates and paddles. An alternative approach would include a computerized system including a microprocessor based CPU and an input device for receiving information relating to the size of the sheets to be stacked. One suitable input device may be a card reader for reading information on cards containing the sheet size. As is known in the art, such an approach may necessitate the use of resolvers or decoders to provide the computer with information relating to position of the various components.

Figure 5:
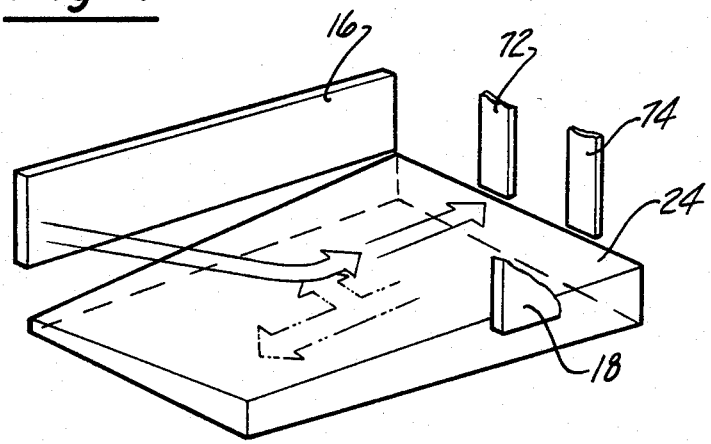
FIG. 5 is a perspective view which pictorially illustrates the movement of the sheets as they are stacked.
Figure 4:
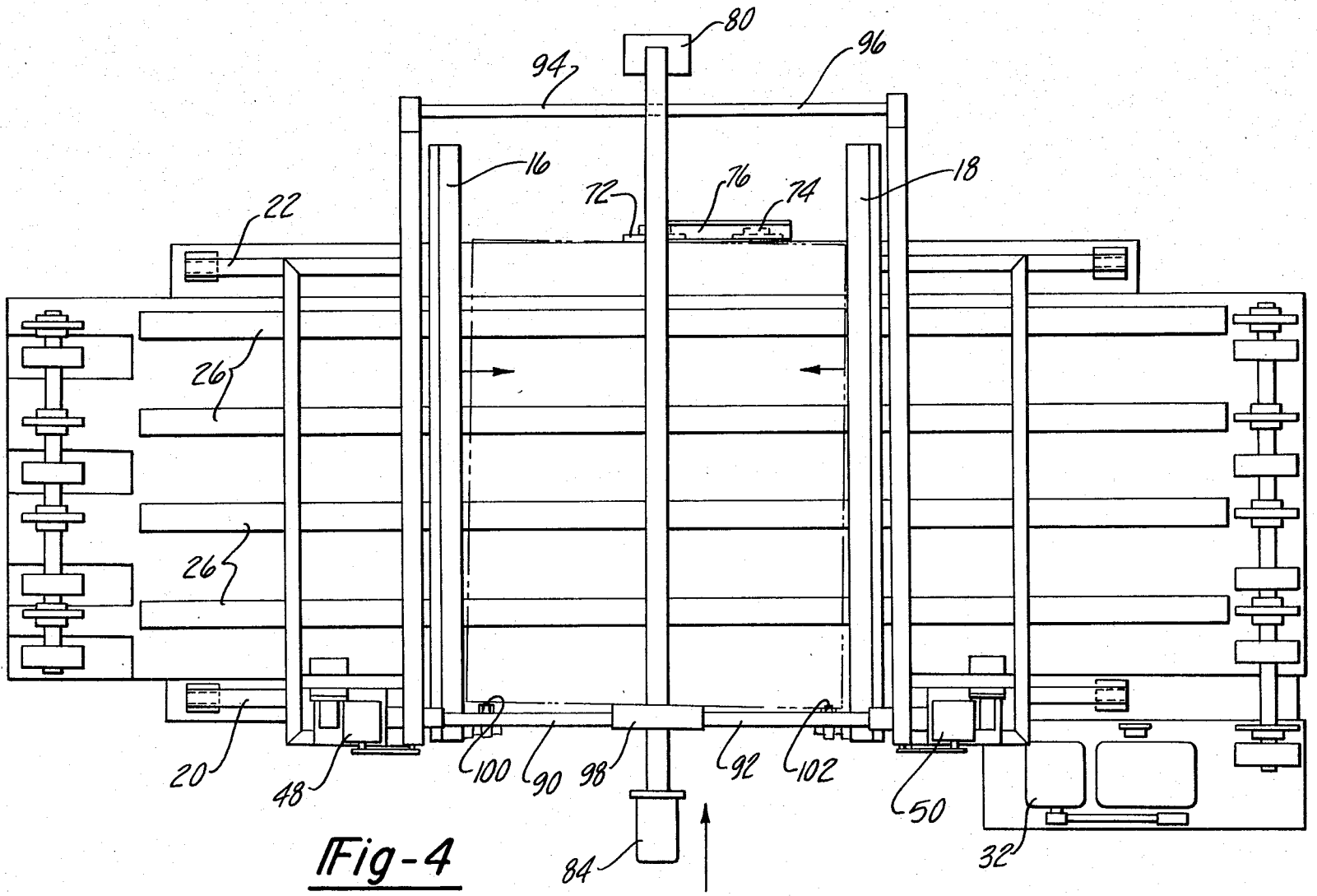
FIG. 4 is a top elevation view.

Preferably, sheet stacking system 10 is oriented in a complex angle as diagramatically illustrated in FIG. 5. This may be accomplished by the use of shims (as shown in FIG. 1) or jacks as illustrated by the reference numerals 112 in the other figures. As the sheets exiting from the cutting machine are fed via a ramp (not shown) towards the stacking area 30, the side edge of the sheet will temporarily ride on the sloped top portion of side gate 16 and then begin to fall down onto pallet 28. The forward edge of the sheet contacts the swinging paddles, 72, 74 which urge the sheet back towards the stops 100, 102. When swinging paddle 74 rebounds, it taps an offset forward edge portion of the sheet and causes it to skew slightly, with opposing corners of the sheet touching points on gates 16 and 18 as shown most clearly in FIG. 4. This process causes all of the sheets to be very accurately stacked on top of one another. After the last sheet has been stacked, the gates 16 and 18 are lifted and the conveyor 24 energized to bring the pallet 28 out of the stacking area ready to be moved to another location within the plant.

Those skilled in the art will come to appreciate various advantages of the present invention and that there are various modifications to the system that can be made after a study of the specification, drawings and following claims. Therefore, while this invention has been described in connection with a particular example thereof, no limitation is intended thereby except as defined in the appended claims.

We claim:

1. A system for stacking sheets of material onto a pallet comprising:

a conveyor arranged for movement along a longitudinal axis and adapted to support a pallet onto which sheets are successively fed in a direction substantially normal to said longitudinal axis to form a stack of sheets on the pallet;

a pair of side gates extending transversely across the conveyor on opposite sides of, and equidistant from, a central stacking axis extending transversely across the conveyor in general alignment with the feed direction of the sheets;

first motive power means for automatically moving said side gates oppositely and in unison in directions normal to said central stacking area axis to vary the spacing between said gates while maintaining their equidistant relationship to said central stacking area axis;

second motive power means for automatically lifting the gates up from the conveyor to allow the conveyor to move a pallet into and out of the stacking area;

rigid stop means located at the sheet entry end of the stacking area;

flexible stop means at the opposite end of the stacking area including at least one swinging panel for contacting a forward edge of the sheets as they are fed into the stacking area;

third motive power means for automatically moving said flexible stop means in a direction parallel to the stacking area axis; and, controller means for selectively energizing at least the first and third motive power means to position the gates and flexible stop means at desired positions to substantially conform the stacking area to various sheet sizes.

2. The improvement of claim 1 wherein said first motive power means comprises:

a screw drive mechanism including a screw with a first portion having a left hand thread and a second portion with a right hand thread; means for supporting one of the gates and being coupled to the left hand thread portion of the screw; and, means for supporting the other gate and coupled to the right hand thread portion of the screw.

3. In a system for stacking sheets of material onto a pallet positioned on a conveyor oriented at a complex angle, the improvement comprising:

a pair of side gates extending transversely across the conveyor with each gate supported by a scaffold riding on a track disposed alongside the conveyor;

first motive power means for automatically moving said side gates in unison in a direction normal to a central stacking area axis extending transversely across the conveyor, said first motive power means comprising a screw drive mechanism including a screw with a first portion having a lefthand thread and a second portion with a righthand thread, means for supporting one of the gates and coupled to the lefthand thread portion of the screw, and means for supporting the other gate and coupled to the righthand thread portion of the screw;

second motive power means for automatically lifting the gates up from the conveyor to allow the pallet to move into and out of the stacking area;

rigid stop means located at one end of the stacking area;

flexible stop means on the opposite end of the stacking area including at least one swinging panel for contacting a forward edge of the sheets as they are fed into the stacking area;

third motive power means for automatically moving said flexible stop means in a direction parallel to the stacking area axis; and controller means for selectively energizing at least the first and third motive power means to position the gates and flexible stop means at desired positions to substantially conform the stacking area to various sheet sizes.

4. The improvement of claim 3 wherein said second motive power means is supported on each of the scaffolds.

5. The improvement of claim 4 wherein said third motive power means comprises:

a screw drive mechanism supported by a framework located above the central stacking area axis.

6. The improvement of claim 5 which further comprises:

at least one pair of telescoping tubes connected at opposite ends to each of the scaffolds and having middle portions thereof supporting the framework for the screw drive mechanism of the third motive power means.

7. Apparatus for stacking sheets of material onto a pallet positioned on a conveyor, said apparatus comprising:

a pair of side gates extending transversely across the conveyor, a first scaffold for supporting one of the gates, a second scaffold for supporting the other gate, each of the scaffolds riding on tracks disposed along side of the conveyor, a screw drive mechanism including a screw with a left hand thread formed in one portion thereof and a right hand thread formed in another portion thereof, means for coupling the left hand thread to one of the scaffolds, means for coupling the right hand thread of the screw to the other scaffold, and a reversible screw drive motor for rotating the screw whereby rotation thereof operates to move said scaffolds in unison in a direction normal to a central stacking area axis extending transversely across the conveyor;

each of the scaffolds containing a gate lift motor for automatically lifting the gates up from the conveyor to allow the pallet to move into and out of the stacking area;

rigid stop means located on one end of the stacking area;

at least one paddle located on an opposite end of the stacking area, a frame member located above the stacking area, motive power means connected to the frame member for moving a traveller along the central stacking area axis, and means for pivotally mounting said paddle to the traveller; and controller means connected to the screw motor, the gate lift motor, and paddle motive power means for automatically positioning said gates and paddles at a desired location to define the stacking area for sheets of various sizes.

* * * * *